United States Patent [19]

Hoover

[11] 4,092,024

[45] May 30, 1978

[54] SUPPORT POST FOR GAME NET

[75] Inventor: Richard L. Hoover, Phoenix, Ariz.

[73] Assignee: Net Posts Inc., Phoenix, Ariz.

[21] Appl. No.: 686,706

[22] Filed: May 17, 1976

[51] Int. Cl.[2] ..... A63B 61/00

[52] U.S. Cl. ..... 273/29 BF; 256/37

[58] Field of Search ..... 273/29 BB, 29 BC, 29 BF, 273/29 BE; 256/1, 37

[56] References Cited

U.S. PATENT DOCUMENTS

| | | | |
|---|---|---|---|
| 2,497,596 | 2/1950 | Frieder et al. | 135/1 R |
| 3,931,965 | 1/1976 | Grant | 273/29 BF |

FOREIGN PATENT DOCUMENTS

| | | | |
|---|---|---|---|
| 592,649 | 1/1934 | Germany | 273/29 BB |
| 9,529 of | 1889 | United Kingdom | 273/29 BE |
| 290,394 | 5/1928 | United Kingdom | 273/29 BB |
| 397,950 | 9/1933 | United Kingdom | 273/29 BE |

*Primary Examiner*—Richard C. Pinkham
*Assistant Examiner*—T. Brown
*Attorney, Agent, or Firm*—Harry M. Weiss

[57] ABSTRACT

An elongate support post is held in an upright position by the lower end thereof which is detachably received in a socket extending subterraneously from the surface of a game court. The support member has a channel at the top thereof which receives the uppermost rope of the net and conducts it to the other side of the member. A rope guide transmits the rope back through the support member to operatively adjustable straining means. Stop means carried by the support member abut the playing surface to provide a predetermined net height.

5 Claims, 5 Drawing Figures

SUPPORT POST FOR GAME NET

This invention relates to recreational and game apparatus.

In a further aspect, the instant invention relates to games of the type having a court which is divided by a net.

More particularly, the present invention concerns an improved support post for holding a game net.

In various games, the contestants are separated by a barrier over which they pass a missile between them. Exemplary are tennis, volleyball and badminton. In general, games of this type are played on a court of specified size having either a natural or an artificial surface. The playing surface is laterally medially divided by a net extending between a pair of upright posts, one at either side of the court. The players attempt to alternate in propelling a missile, such as a ball or shuttlecock, over the net. In volleyball, a large resilient ball is batted by hand. Racquets are used to strike the ball and shuttlecock in tennis and badminton, respectively.

The rules and regulations concerning game play and court layout are well defined. Included in the regulations are specifications governing the net and net supports posts, the concern of the instant invention. Precise physical dimensions establish the height of the net as measured at the ends and the allowable sag at the center of the net. This dictates that the support posts include means for engaging the upper rope of the net at the required height and means for straining the rope to proper sag.

Other criteria must be considered in the design of a functionally effective net supporting game post. Ideally, a post should be durably constructed, immune to environmental deterioration, free of hazardous protuberances and uninviting to vandalism. Additionally, since posts are frequently moved, provisions must be made for ease of manipulation, such as removal and placement, and relaxing and straining of the net.

In contrast to the foregoing optimum design criteria, prior art posts or supporting game nets commonly employ a pulley for receiving the upper rope of the game net and a crank and gear system for straining. The pulleys and gears are subject to rust, accumulations of dirt and debris, breakage and other deleterious effects. The handle of the crank projecting from the post presents an immediate physical hazard to the players. Crank handles are also enticing to those bent on theft or vandalism. Since the posts generally must rest upon the bottom of the socket in order to insure a properly installed height, it is necessary that the attendant thoroughly clean the socket prior to inserting the post. This, of course, requires additional time of the court attendant and, coupled with the above limitations, adversely affects the cost of maintenance. Further extraneous maintenance is required to keep the mechanism, pulleys and gears, in working order.

It would be highly advantageous, therefore, to provide an improved support post, especially for game nets, which is more closely in accord with actual requirements than is displayed by the prior art.

Accordingly, it is a principal object of the present invention to provide an improved post for supporting a game net at a predetermined height.

Another object of the instant invention is the provision of a support having straining means of relatively few parts which are substantially impervious to environmental deterioration.

And another object of the invention is to provide a support post which will receive and transmit through a system of non-moving parts the uppermost rope of a game net to the straining device.

Still another object of the present invention is the provision of a support post which is highly compact and substantially free of projections which could cause injury to players.

Yet another object of the present invention is to provide a net supporting game post which is generally free of vandalism-enticing attachments.

A further object of the instant invention is the provision of a support post which is readily erectable to receive the game net at a predetermined height above the game court surface without regard to placement or condition of the socket into which it is placed.

And a further object of the invention is the provision of a net supporting game post which is relatively simple and inexpensively manufactured, yet is durably constructed and requires minimal maintenance.

Briefly, to achieve the desired objectives of the present invention in accordance with a preferred embodiment therefor, first provided is a rigid, elongate support member having an upper end and a lower end. The lower end is received subterraneously through the court surface to hold the support member in a generally upright position. A channel proximate the upper end of the support member receives the uppermost rope of the game net and guides the rope to the side of the post opposite the net. The rope returns to the net side of the post through a rope guide and is engaged with retaining means for operatively straining the rope.

In a further embodiment, the channel extends arcuately downward from the net side of the post to the outside of the post for the purpose of preventing abrasion and localized strain upon the rope. Similarly, the guide extends diagonally downward and is provided with transition means at either end thereof over which the rope bends. In accordance with a further embodiment, the straining means includes an elongate shaft having rope securing means at the upper end thereof. The lower end of the elongate shaft passes through an aperture in a lug extending from the inside surface of the support member and is provided with means for operatively advancing the shaft in a direction to strain the rope.

The foregoing and further and more specific objects and advantages of the present invention will become readily apparent to those skilled in the art from the following detailed descriptions of the preferred embodiments thereof, taken in conjunction with the drawings, in which.

Figure 1:
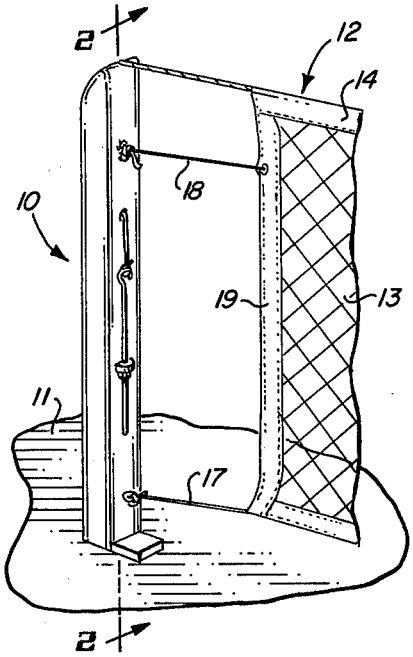
FIG. 1 is a perspective view of a support post constructed in accordance with the teachings of the present invention as it would appear when erected in supporting a game net, herein specifically shown as a tennis net.
Figure 3:
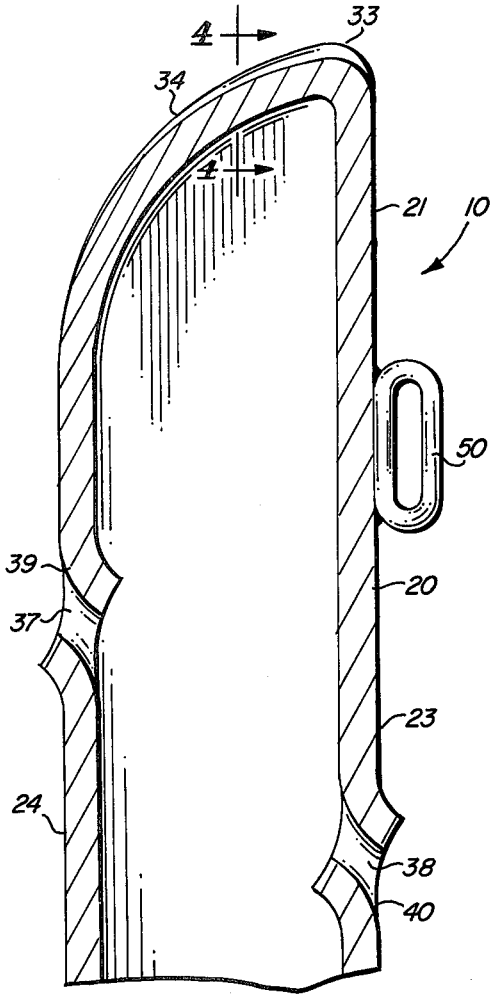
FIG. 3 is an enlarged vertical sectional view of the upper end of the support post generally corresponding to FIG. 2.

Turning now to the drawings in which like reference characters denote corresponding elements throughout the several views, attention is first directed to FIG. 1 which shows a support post, generally designated by the reference character 10, of the instant invention as it would appear when projecting upwardly from court 11 and holding game net 12. Although the support post of the instant invention is usable with various types of nets, such as volleyball nets and badminton nets, a particular embodiment chosen for purposes of illustration in the drawings has specific utility as a tennis support post. As will be readily apparent to those skilled in the art, embodiments for other particular purposes differ only as a matter of overall length.

Tennis net 12 includes a net section 13 having an upper rope 14, usually a metal cable, from which net 13 is suspended. Lower cord 17 and intermediate cord 18 extend from edge 19 for the purpose of steadying net 13.

Figure 2:
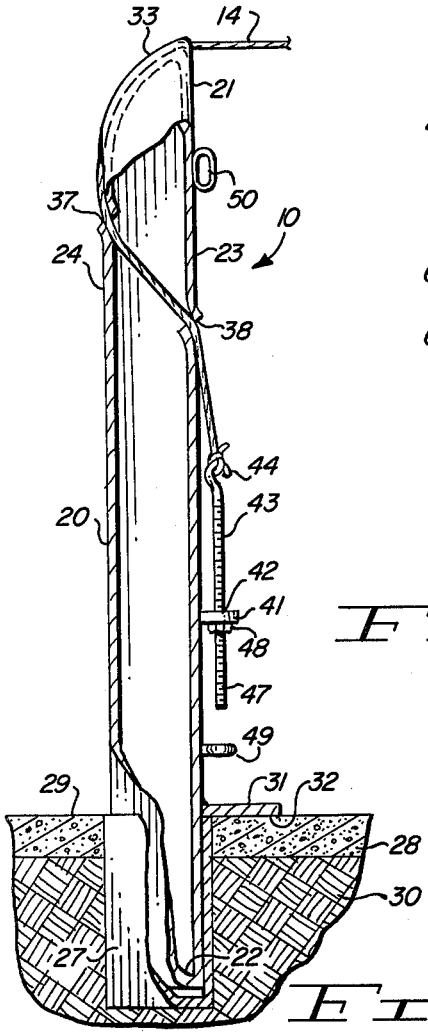
FIG. 2 is a vertical sectional view taken along the line 2—2 of FIG. 1 and further illustrating the elements thereof.

Referring now to FIG. 2, support post 10 includes a rigid, elongate support member 20 having upper and lower ends 21 and 22, respectively. For clarity of illustration, support member 20 is considered to have an inside longitudinal surface 23, which is the side adjacent the net, and an outside longitudinal surface 24. Lower end 22 of support member member 20 is received in subterranean socket 27. Socket 27 is sized and shaped to closely receive lower end 22 to hold support member 20 in an upright position with minimum movement, yet with a sliding fit, such that support member 20 is readily removable. In accordance with conventional practice, socket 27 extends downwardly through the court material 28 from surface 29 thereof into the ground 30. Generally, such sockets are positioned prior to the laying of court material 28, with the intention that the surface of the court and the upper edge of the socket are flush. The post 10 is provided with small tabs which rest upon the upper edge of the socket 27 or, alternately, the lower edge of the post abuts the bottom of the socket. However, if an error is made during construction, or the court is subsequently resurfaced with additional material, the height of the post is altered and corrections must be made.

In accordance with the instant invention, socket 27 is deeper than the portion of support member 20 to be received therein. Flange 31 has a contact surface 32 on the underside thereof which abuts the surface 29 of a court material 28. The relationship with the overall height of the net will be explained presently. The extended depth of socket 27 also eliminates the necessity of removing debris and thoroughly cleaning the bottom of the socket prior to insertion of the support member 20.

Upper end 21 of support member 20 is closed by surface 33 which extends arcuately downward from inner surface 23 to outer surface 24. The approximate center of surface 33 is indented to form channel 34 which follows the arcuate contour thereof from inner surface 23 to outer surface 24.

Support member 20 is specifically shown herein as a hollow box member fabricated of metal, such as steel of aluminum, as will be readily understood by those in the metalworking art. A first aperture 37 extends through outer surface 24 below the termination of channel 34. A second aperture 38 extends through inner surface 23 at a distance below first aperture 37. First and second apertures 37 and 38 form a rope guide which extends diagonally downward from outer surface 24 to inner surface 23. In an alternate embodiment of the instant invention, in which support member 20 is a solid element, the rope guide would be a single bore extending therethrough.

Upper rope 14 is received in channel 34 which guides the rope from inner surface 23 to outer surface 24. Rope 14 passes downwardly from groove 34 along outer surface 24 and extends through the rope guide formed by apertures 37 and 38 to be again adjacent inner surface 23. The material of outer surface 24 and inner surface 23 immediately surrounding first aperture 37 and second aperture 38, respectively, is distorted to provide arcuate surfaces 39 and 40. Arcuate surfaces 39 and 40 function as transition means to the entrance and exit respectively of the rope guide, insuring that the upper rope 14 will not be abraided or damaged as it passes therethrough.

Lug 41 having aperture 42 extending therethrough extends from inner surface 23, and is secured thereto as by welding, at a position spaced below second aperture 38. Elongate shaft 43 having hook-shaped upper end 44 is slideably received through aperture 42 at lug 41. Shaft 43 has an external male screw flight commencing at the lower end 47 and extending substantially the length thereof. Nut 48, having an internal female screw flight, is threadedly engaged with shaft 43 and is placed on the underside of lug 41. Rope 14 is engaged with the upper end 44 of elongate shaft 43. As nut 48 is rotated, clockwise for conventional right-hand thread, shaft 43 advances through aperture 42 in a direction away from aperture 38. Lug 41, shaft 43 and nut 48 function as retaining means for engaging and operatively straining upper rope 14. During the straining operation, upper rope 14 slides in channel 34 and through the rope guide as formed by first and second apertures 37 and 38.

As will be apparent to those skilled in the art, upper end 44 of shaft 43 may be shaped as an eye, a hook, or other equivalencies to which rope 14 may be secured. It is preferred, however, that upper end 44 have an enlarged end. The enlarged end is held in close proximity to inner surface 23 by the tension of rope 14, thereby preventing shaft 14 from rotating as nut 43 is turned in either direction for tightening or loosening.

The rules governing the height of nets, especially for tournament play, are exacting. In tennis, for example, the height of the net at the post is 42 inches, which distance is to be held as nearly as possible. In accordance with the instant invention, the exact height is predetermined by the manufacturer by the placement of contact surface 32 is definite relationship to channel 34. This eliminates error by the attendant, debris accumulated in the bottom of socket 27, or resurfacing the game court. Further, should socket 27 settle during construction, such that the upper edge thereof is below the surface of the court, exact net height above the surface of the court is unaltered. Rings 49 and 50 secured to inner surface 23 provide for the attachment of lower cords 17 and 18, respectively.

Figure 5:
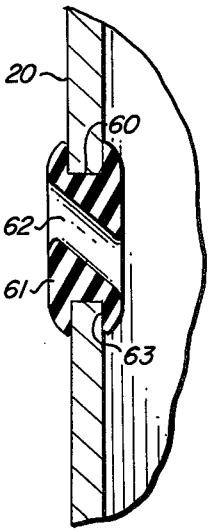
FIG. 5 is a fragmentary vertical sectional view of a portion of the post of FIG. 1 and illustrating an alternate embodiment thereof.
Figure 4:
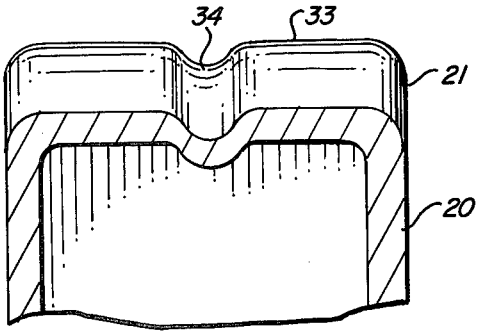
FIG. 4 is a vertical sectional view taken along the line 4—4 of FIG. 3.

FIG. 5 illustrates an alternate embodiment of the instant invention, wherein the apertures, previously designated as 37 and 38, extending through the walls of support member 20, are enlarged, as will be seen by the aperture 60. It is also noted that the material surrounding aperture 60 is straight and not distorted, as described in connection with the previous embodiment. A grommet 61, preferably fabricated of a plastic material, such as nylon or Teflon, having an aperture 62 therethrough, is received and held within support member 20 by means of a circumferential groove 63 which receives the edge of the wall of member 20 as defined by aperture 60. Preferably, aperture 62 extends angularly through grommet 61 to assist in the transition of rope 14 from the vertical surface of the support member to the diagonal rope guide. A corresponding aperture and grommet are located within the opposite wall of support member 20.

Various changes and modifications to the embodiments herein chosen for purposes of illustration will readily occur to those skilled in the art. For example, the diagonal rope guide can be readily replaced by a rope guide extending perpendicularly through the support member. Similarly, the socket may be discarded and the lower end of the support member received directly into the ground, whether the court has an especially prepared surface or not. Further, the rope may be engaged with the retaining and straightening means and the device advanced by means other than those specifically shown.

Having fully described and disclosed the present invention in such complete nd concise terms as to enable those skilled in the art to understand and practice the same, the invention claimed is:

1. A support post apparatus holding and supporting a game net above the surface of a game court, which game net includes at least one rope type member supporting said net in a spaced relationship above the surface of the game court said support post apparatus comprising, in combination, a net, a rope-type member supporting said net and a rigid, substantially hollow, elongate support member having an upper end portion and a lower end portion, said rigid elongate support member having a first longitudinal surface and a second longitudinal surface, said first longitudinal surface being the surface adjacent said net, said support member having means defining a channel proximate the upper end portion of said support member for receiving and guiding said rope type member; said support member having guide means extending through at least one wall of said support member and spaced from said channel means for passage of said one rope type member from said second surface to said first surface; and retaining means coupled to said first surface of said support member for engaging and operatively straining said rope type member.

2. The support post of claim 1, wherein said guide means extends through two walls of said support member.

3. The support post of claim 1, wherein said guide means extends diagonally downward from said second surface to said first surface, said guide means comprising means defining an aperture having a first open end in said second surface and a second open end in said first surface, said second open end being spaced below said first open end.

4. The support post of claim 1 including a socket extending subterraneously from the court surface for receiving the lower end portion of said support member and for holding said support member in a generally upright position, and means proximate the upper end portion of said support member for receiving and engaging said rope type member of said net, improvements therein comprising: stop means carried by said support member and having a contact surface on the underside thereof abutting the surface of said game court and located at a selected predetermined distance from said receiving and engaging means for holding said net at said selected predetermined distance from the surface of said game court when said support member is placed in said socket.

5. A support post for holding and supporting a game net above the surface of a game court, which game net includes at least one rope type member for supporting said net in a spaced relationship above the surface of the game court, said support post comprising, in combination, a rigid, substantially hollow, elongate support member having an upper end portion and a lower end portion, said rigid elongate support member having a first longitudinal surface and a second longitudinal surface, said first longitudinal surface being the surface adjacent said net, said support member having means defining a channel proximate the upper end portion of said support member for receiving and guiding said one rope type member; said support member having guide means extending through at least one wall of said support member and spaced from said channel means for passage of said one rope type member from said second surface to said first surface; and retaining means coupled to said first surface of said support member for engaging and operatively straining said rope type member, said retaining means comprises:

(a) a lug extending from said first surface of said support member and having an aperture therethrough;

(b) an elongate shaft having an upper end and a lower end slideably received through the aperture in said lug and having securing means at the upper end thereof for securing said rope type member, and (c) means for operatively advancing said shaft relative said lug in a direction away from said guide means for selective straining of said rope type member.

* * * * *